US011134770B2

(12) United States Patent
Valentsov

(10) Patent No.: US 11,134,770 B2
(45) Date of Patent: Oct. 5, 2021

(54) APPARATUS FOR CARRYING AND TRANSPORTING GOODS

(71) Applicant: Mikhail Valentsov, Moscow (RU)

(72) Inventor: Mikhail Valentsov, Moscow (RU)

( * ) Notice: Subject to any disclaimer, the term of this patent is extended or adjusted under 35 U.S.C. 154(b) by 98 days.

(21) Appl. No.: 16/698,722

(22) Filed: Nov. 27, 2019

(65) Prior Publication Data

US 2020/0297102 A1 Sep. 24, 2020

(30) Foreign Application Priority Data

Mar. 18, 2019 (RU) ..... RU2019107589

(51) Int. Cl.
*A45F 5/10* (2006.01)

(52) U.S. Cl.
CPC ..... *A45F 5/10* (2013.01); *A45F 2005/1013* (2013.01)

(58) Field of Classification Search
CPC ..... A45F 5/10; A45F 2005/1006; A45F 2005/1013
USPC ..... 294/150, 151, 153, 165
See application file for complete search history.

(56) References Cited

U.S. PATENT DOCUMENTS 704,368 A * 7/1902 Pond
1,056,068 A * 3/1913 Sprague ..... A45F 5/10 294/156
1,120,020 A * 12/1914 Bullock ..... A45F 5/10 294/155
2,997,218 A * 8/1961 Kobles ..... B65D 63/18 294/150
3,172,586 A * 3/1965 Lu ..... A45F 5/12 294/155
4,458,933 A * 7/1984 Thomas ..... B65G 7/12 294/137
4,828,310 A * 5/1989 Schmidt, Jr. ..... A45F 5/004 294/150
2006/0043136 A1* 3/2006 Werts ..... A45F 5/12 224/607

FOREIGN PATENT DOCUMENTS

EP 0 250 655 * 1/1988 ..... A45F 5/10

* cited by examiner

*Primary Examiner* — Dean J Kramer

(57) ABSTRACT

An apparatus for carrying and transporting goods can be used to carry and/or transport a good without the use of auxiliary items. The apparatus for carrying and transporting goods includes a structural channel, a handle, a fastening mechanism, a guiding mechanism, and a tether. The structural channel is the main support of the apparatus. The handle allows a user to carry a good that is engaged by the apparatus. The fastening mechanism is used to fully secure the tether around the good in order to engage the apparatus onto the good. The guiding mechanism is used to guide the tether into and out of the structural channel in order to form a loop that can be wrapped around the good. The tether may be a rope, a chain, a band, or a wire.

12 Claims, 6 Drawing Sheets

APPARATUS FOR CARRYING AND TRANSPORTING GOODS

The current application claims a priority to the Russian patent application serial number 2019107589 filed on Mar. 18, 2019.

FIELD OF THE INVENTION

The present invention relates generally to carrying devices. More specifically, the present invention is an apparatus for carrying and transporting goods. The present invention can be used to carry and/or transport a good without the use of auxiliary items.

BACKGROUND OF THE INVENTION

The packaging and transporting of goods is a common practice processed by delivery services. Additionally, regular individuals may also be involved in the packaging and transporting of goods when traveling or moving into a new residency. The most common method of packaging and transporting a good is to place the good into a box, seal the box, and transport the box. This method requires an individual to find a properly sized box in order to package a good and materials in order to seal the box. Further, a large box is not easy to carry around. Other methods of packaging and transporting a good also require the use of auxiliary items that must be properly sized and compatible for various goods. There exists a need for a device that can be used to carry and/or transport a good without the requirement of using auxiliary items and without the need to be properly sized or compatible.

It is therefore an objective of the present invention to provide an apparatus for carrying and transporting goods that allows a user to carry and transport any good without the use of auxiliary items. The present invention includes a structural channel with a handle that allows a user to easily carry any good. Further, the present invention includes a tether and fastening mechanism. The tether is guided through the structural channel in order to form a loop that can be wrapped around a good. The fastening mechanism is used to secure the tether around the good and to the structural channel. Thus, a user can carry and/or transport the good engaged by the present invention.

DETAIL DESCRIPTIONS OF THE INVENTION

Figure 1:
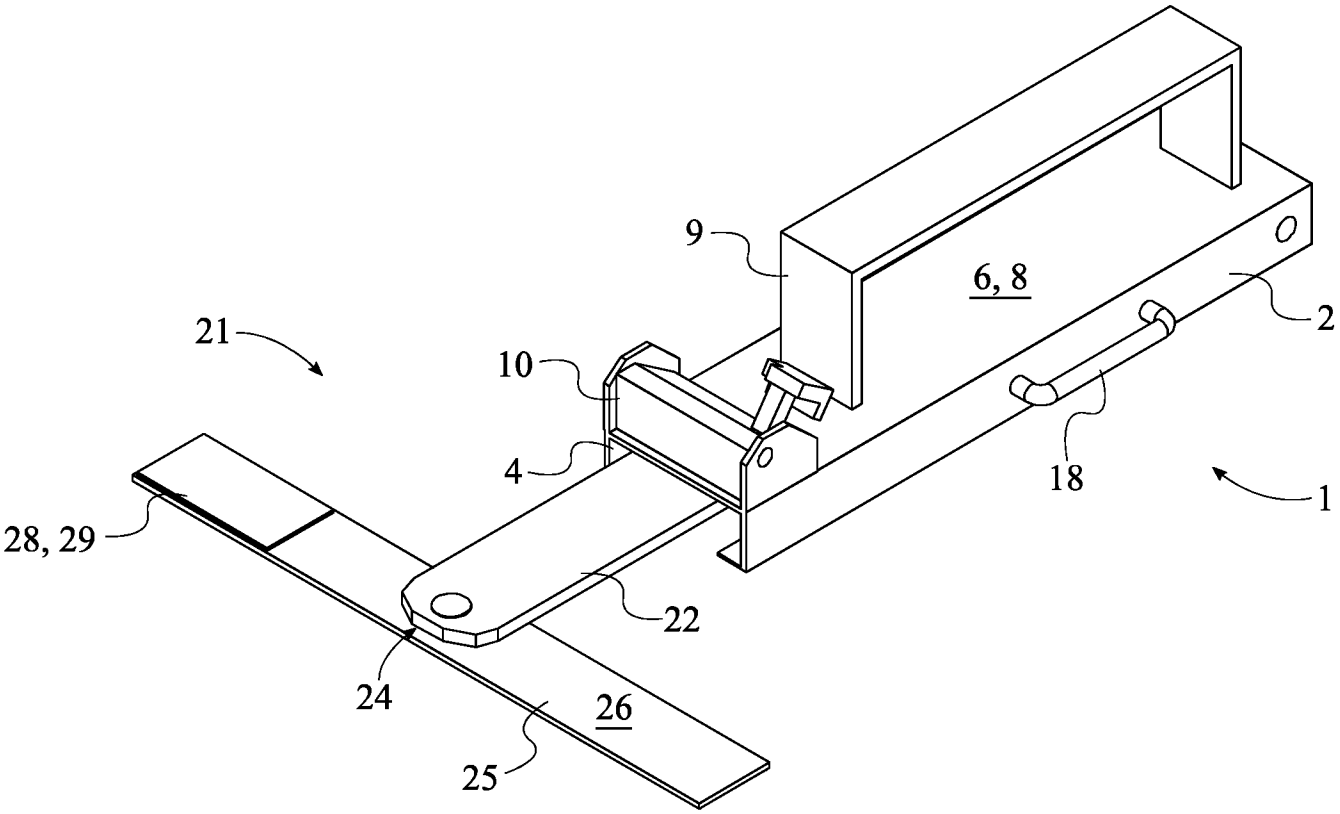
FIG. 1 is a front perspective view of the present invention.

All illustrations of the drawings are for the purpose of describing selected versions of the present invention and are not intended to limit the scope of the present invention.

In reference to FIGS. 1 through 5, the present invention is an apparatus for carrying and transporting goods. The present invention can be used to carry and/or transport a good without the use of auxiliary items. A good can be any item that includes a solid shape in order to be carried and transported by an individual. The present invention comprises a structural channel 1, a handle 9, a fastening mechanism 10, a guiding mechanism 11, and a tether 15. The structural channel 1 is the main support of the present invention. In further detail, the structural channel 1 is used to support the handle 9, the fastening mechanism 10, and the tether 15. The handle 9 allows a user to carry a good that is engaged by the present invention. The fastening mechanism 10 is used to fully secure the tether 15 around the good in order to engage the present invention onto the good. The guiding mechanism 11 is used to guide the tether 15 into and out of the structural channel 1 in order to form a loop that can be wrapped around the good. The tether 15 may be any fixture attachment means such as, but not limited to, a rope, a chain, a band, or a wire.

Figure 2:
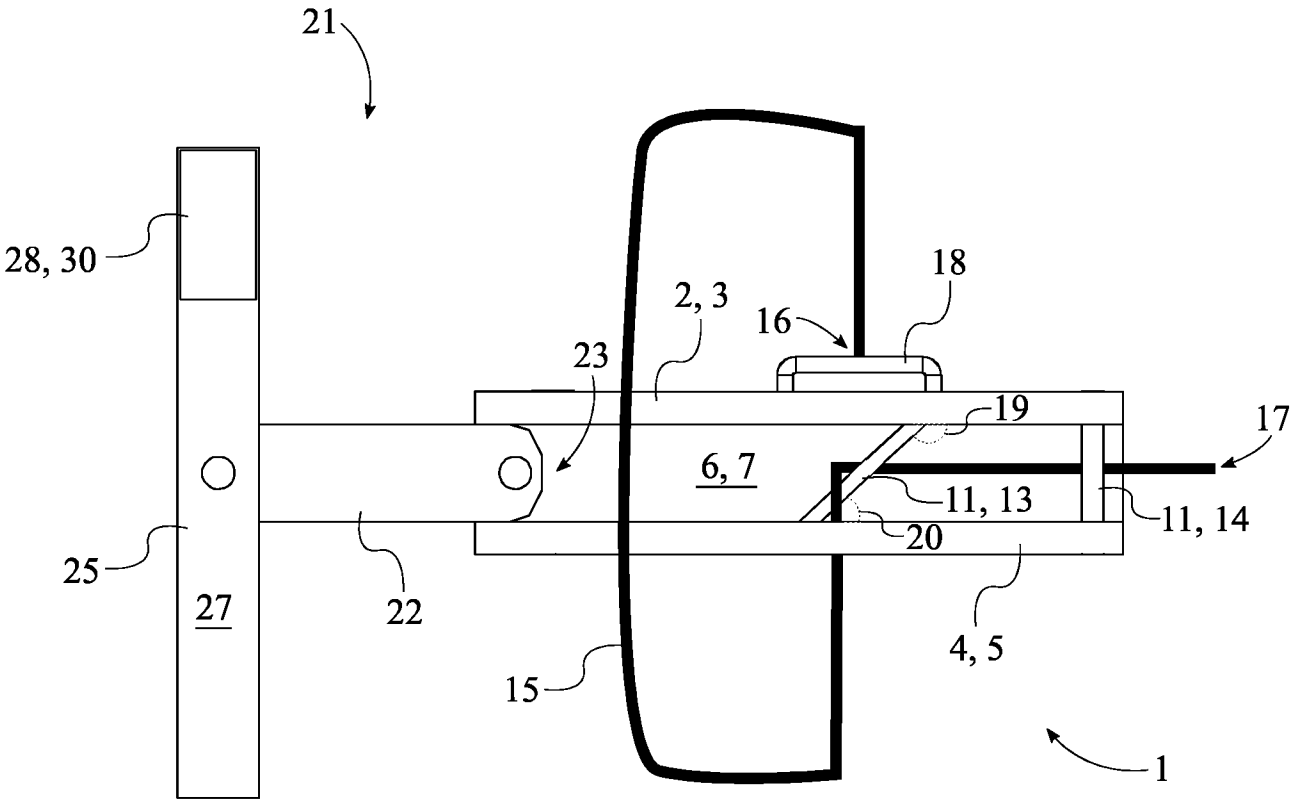
FIG. 2 is a bottom view of the present invention with the securing device in the operative configuration.

The general configuration of the aforementioned components allows the present invention to carry and/or transport a good without the use of auxiliary items. With reference to FIGS. 1 and 2, the structural channel 1 comprises a first leg 2, a second leg 4, and web 6. The tether 15 comprises a fixed end 16 and a free end 17. The web 6 comprises a proximal face 7 and a distal face 8. The first leg 2 and the second leg 4 are mounted onto the proximal face 7. In further detail, the first leg 2 and the second leg 4 are permanently connected to the proximal face 7 wherein the first leg 2, the second leg 4, and the web 6 are one piece. Thus, the structural channel 1 is a rigid piece of material. The handle 9 is mounted onto the distal face 8. In further detail, the handle 9 is mounted onto the distal face 8 by a set of fasteners such as, but not limited, nuts and screws. Thus, the handle 9 may be removed by the user when desired and/or be fully secured to in order to prevent the handle 9 from being pulled off when carrying a good engaged by the present invention. The fixed end 16 is externally positioned to the structural channel 1 and is laterally connected to the first leg 2. This allows the fixed end 16 to be easily accessed by the user in order to connect or remove the tether 15 from structural channel 1 when desired. The guiding mechanism 11 is tensionably engaged by the tether 15 and is operatively integrated into the structural channel 1. In further detail, the guiding mechanism 11 includes features that are integrated into the structural which allows the structural channel 1 to receive the tether 15. Moreover, the guiding mechanism 11 is used to guide the free end 17 through the structural channel 1. This arrangement forms the loop, with the tether 15, that is used to engage the present invention to a good. The fastening mechanism 10 is terminally mounted to the structural channel 1. This arrangement positions the fastening mechanism 10 to allow the user to secure the tether 15 around a good.

Figure 5:
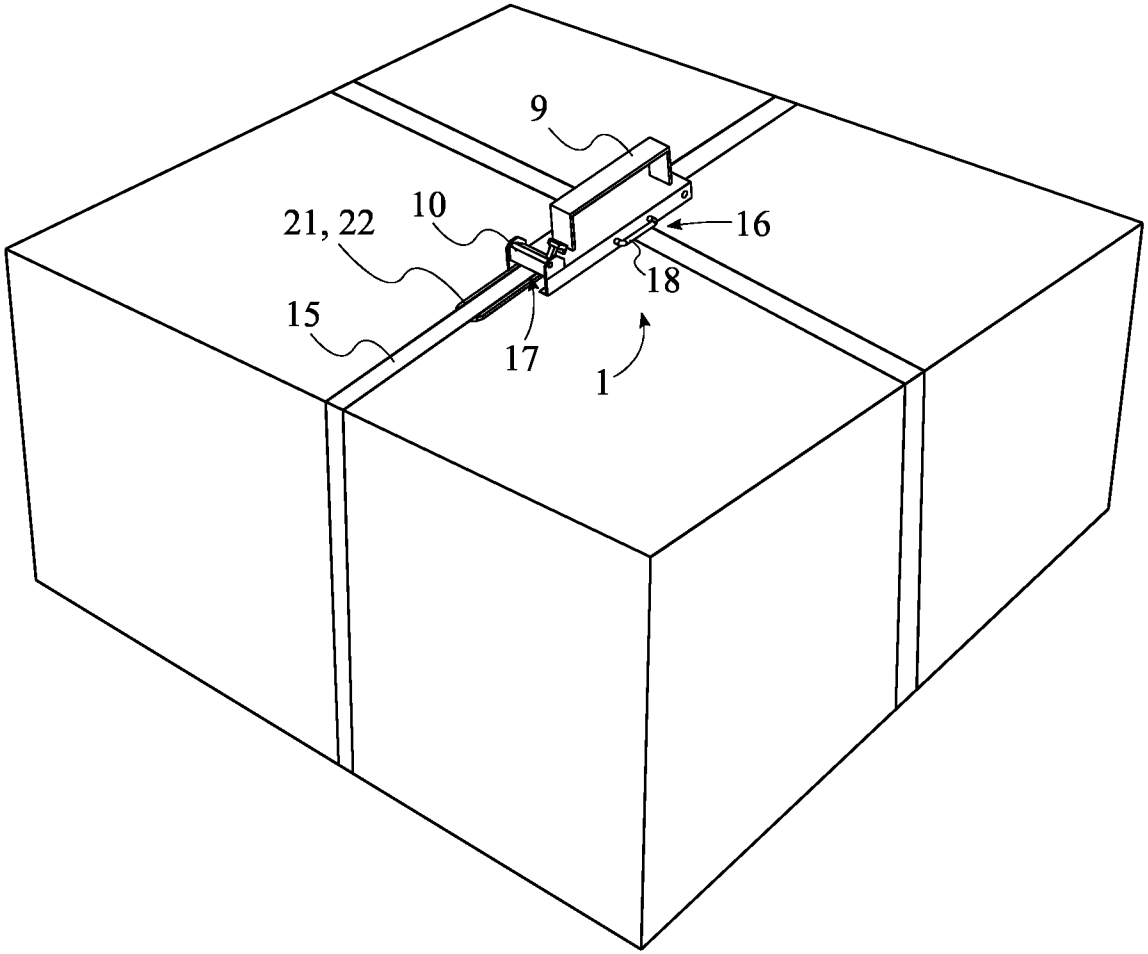
FIG. 5 is a front perspective view of the present invention engaged to a good.

With reference to FIG. 5, the tether 15 can be arranged into an operative configuration. The operative configuration is the configuration where a good is engaged by the present invention allowing the good to be carried and transported. The free end 17 is terminally attached to the structural channel 1 by the fastening mechanism 10. This arrangement fully secures the tether 15 around the good and to the structural channel 1 in order to fully engage the present invention to the good. Thus, the good can be carried and transported by the user through the present invention.

As mentioned previously and with reference to FIGS. 2 and 4, the guiding mechanism 11 includes features to guide the tether 15 through the structural channel 1. Thus, the guiding mechanism 11 comprises a slit 12, a first roller 13, and a second roller 14. The slit 12 traverses through the second leg 4 in order to provide an opening to receive the tether 15. The first roller 13 and the second roller 14 are positioned in between the first leg 2 and the second leg 4 in order to guide the tether 15 through the structural channel 1 once the tether 15 is passed through the slit 12. The first roller 13 is positioned adjacent to the slit 12. This arrangement allows the first roller 13 to engage the tether 15 after the tether 15 is passed through the slit 12. The second roller 14 is terminally positioned to the structural channel 1, opposite to the fastening mechanism 10. This arrangement allows the second roller 14 to engage the tether 15 as it exits the structural channel 1 in order to form the loop. The tether 15 traverses through the slit 12 and is tensionably engaged by the first roller 13 and the second roller 14. Thus, the tether 15 is guided through the structural channel 1 through the guiding mechanism 11.

The present invention may further comprise an anchor 18 in order for the user to connect the tether 15 to the structural channel 1. The anchor 18 is positioned externally to the structural channel 1 and is laterally connected to the first leg 2. This allows the anchor 18 to be easily accessed by the user. Moreover, the anchor 18 and the slit 12 are positioned opposite to each other about the structural channel 1. This arrangement allows the tether 15 to be guided through the structural channel 1 in order to form the loop. Further, the fixed end 16 is rotatably connected to the anchor 18. Thus, the tether 15 is connected to the structural channel 1 which further allows the loop to be formed.

Figure 4:
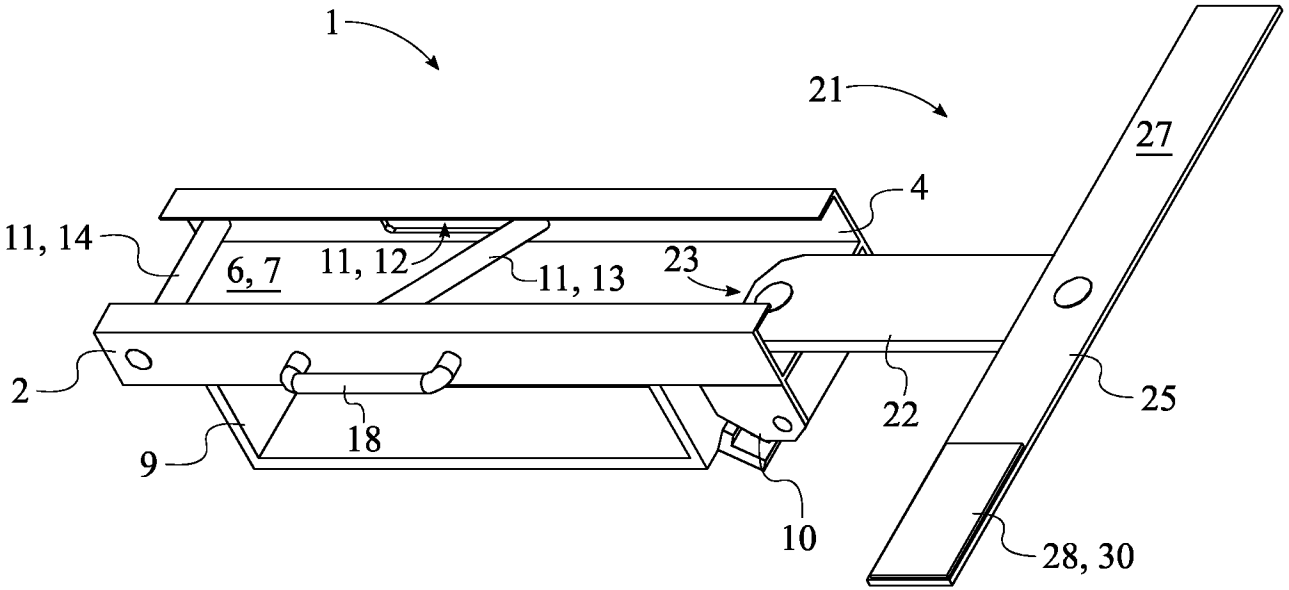
FIG. 4 is a bottom perspective view of the present invention.

With reference to FIGS. 2 and 4, the first roller 13 and the second roller 14 are specifically oriented with respect to the first leg 2 and the second leg 4 in order for the tether 15 to form the loop. Thus, the first leg 2 comprises a first dorsal portion 3 and the second leg 4 comprises a second dorsal portion 5. The first dorsal portion 3 traverses from the first roller 13 to the second roller 14. The second dorsal portion 5 traverses from the first roller 13 to the second roller 14. The first roller 13 is oriented at an obtuse angle 19 with the first dorsal portion 3, and the first roller 13 is oriented at an acute angle 20 with the second dorsal portion 5. This arrangement orients the first roller 13 in order to redirect the tether 15 after the tether 15 traverses through the slit 12. The second roller 14 is oriented normal to the first leg 2 and the second leg 4. This arrangement orients the second roller 14 in order to direct the tether 15 out of the structural channel 1. The orientation of the first roller 13 and the second roller 14 allows the tether 15 to form the loop in order for the present invention to engage the good.

Figure 3:
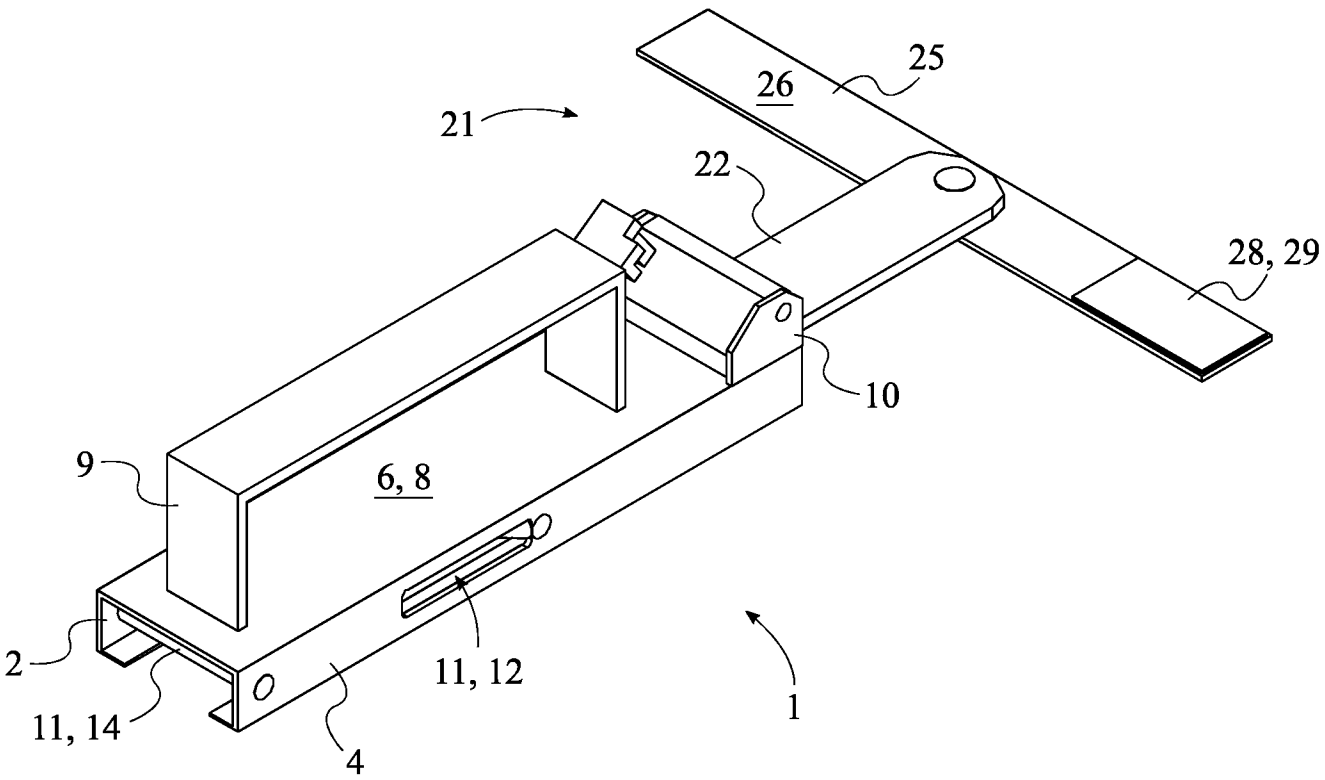
FIG. 3 is a rear perspective view of the present invention.

With reference to FIGS. 3 and 4, the present invention may further comprise a securing device 21 in order to fully secure the free end 17 to the structural channel 1. The securing device 21 comprises an elongated brace 22 and a strap 25. The elongated brace 22 is used to maintain the tether 15 against the structural channel 1 and the strap 25 is used to further secure the tether 15 to the structural channel 1. The elongated brace 22 comprises a first brace end 23 and a second brace end 24. The first brace end 23 is attached in between the first leg 2, and the second leg 4 and is positioned adjacent to the fastening mechanism 10. This arrangement connects the elongated brace 22 to the structural channel 1 and positions the elongated brace 22 in order for the free end 17 to be pressed against the elongated brace 22. The strap 25 is rotatably mounted to the second brace end 24. This allows the user to easily wrap the strap 25 around the free end 17 in order to fully secure the tether 15 around the good and to the structural channel 1.

With reference to FIGS. 3 and 4, the securing device 21 further comprises a fastener 28 in order for the strap 25 to be secured around the free end 17. The fastener 28 is preferably a hook-and-loop fastener 28. The strap 25 comprises a first face 26 and a second face 27. The fastener 28 comprises a first interlocking portion 29 and a second interlocking portion 30. The first interlocking portion 29 is connected onto the first face 26, and the second interlocking portion 30 is connected onto the second face 27. Further, the first interlocking portion 29 and the second interlocking portion 30 are positioned opposite of each other along the strap 25. This allows the strap 25 to be wrapped upon itself in order for the first interlocking portion 29 to engage the second interlocking portion 30. Thus, the strap 25 can be fully secured around the free end 17 by the fastener 28. In order for the strap 25 to be evenly wrapped around the free end 17, the second brace end 24 is centrally positioned along the strap 25.

Figure 6:
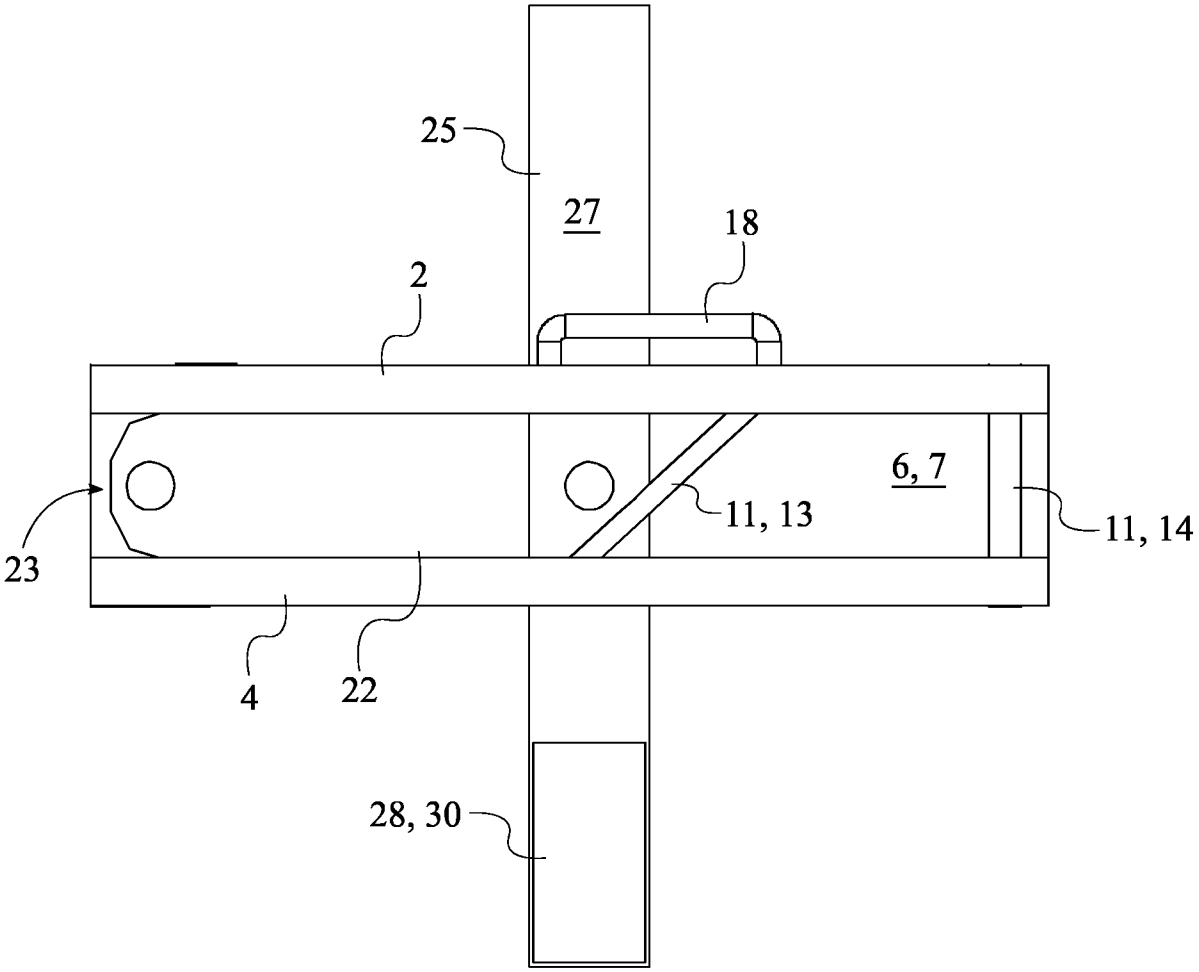
FIG. 6 is a bottom view of the present invention with the securing device in the storage configuration.

With reference to FIGS. 1 and 5, the securing device 21 can be arranged into an operative configuration. The operative configuration is the configuration where the present invention is engaged to the good allowing the good to be carried and transported. The elongated brace 22 traverses out of the structural channel 1 in order to be placed against the free end 17 thereby allowing the strap 25 to be wrapped around the free end 17. Alternatively, and with reference to FIG. 6, the securing device 21 can be arranged into a storage configuration. The storage configuration is the configuration where the present invention is not in use. The elongated brace 22 traverses within the structural channel 1 in order to reduce the amount of space that the present invention would occupy when stored by the user.

As mentioned previously, the fastening mechanism 10 is used to secure the tether 15 around the good and to the structural channel 1. In one embodiment of the present invention, the fastening mechanism 10 is a hook. The tether 15 is engaged by the hook in order to secure the tether 15 around the good and to the structural channel 1. In another embodiment of the present invention, the fastening mechanism 10 is a clamp device. The tether 15 is clamped by the clamp device in order to secure the tether 15 around the good and to the structural channel 1.

Although the invention has been explained in relation to its preferred embodiment, it is to be understood that many other possible modifications and variations can be made without departing from the spirit and scope of the invention as hereinafter claimed.

What is claimed is:

1. An apparatus for carrying and transporting goods comprises:

a structural channel;
a handle;
a fastening mechanism;
a guiding mechanism;
a tether;
the structural channel comprises a first leg, a second leg, and a web;
the tether comprises a fixed end and a free end;
the web comprises a proximal face and a distal face;
the first leg and the second leg being mounted onto the proximal face;
the handle being mounted onto the distal face;
the fixed end being externally positioned to the structural channel;
the fixed end being laterally connected to the first leg;
the guiding mechanism being tensionably engaged by the tether;

the guiding mechanism being operatively integrated into the structural channel, wherein the guiding mechanism is used to guide the free end through the structural channel;

the fastening mechanism being terminally mounted to the structural channel;

a securing device;

the securing device comprises an elongated brace and a strap;

the elongated brace comprises a first brace end and a second brace end;

the first brace end being attached in between the first leg and the second leg;

the first brace end being positioned adjacent to the fastening mechanism; and the strap being rotatably mounted to the second brace end.

2. The apparatus for carrying and transporting goods as claimed in claim 1 comprises:

wherein the tether is arranged into an operative configuration; and the free end being terminally attached to the structural channel by the fastening mechanism.

3. The apparatus for carrying and transporting goods as claimed in claim 1 comprises:

the guiding mechanism comprises a slit, a first roller, and a second roller;

the slit traversing through the second leg;

the first roller and the second roller being positioned in between the first leg and the second leg;

the first roller being positioned adjacent to the slit;

the second roller being terminally positioned to the structural channel, opposite to the fastening mechanism;

the tether traversing through the slit; and the tether being tensionably engaged by the first roller and the second roller.

4. The apparatus for carrying and transporting goods as claimed in claim 3 comprises:

an anchor;

the anchor being positioned externally to the structural channel;

the anchor being laterally connected to the first leg;

the anchor and the slit being positioned opposite to each other about the structural channel; and the fixed end being rotatably connected to the anchor.

5. The apparatus for carrying and transporting goods as claimed in claim 3 comprises:

the first leg comprises a first dorsal portion;

the second leg comprises a second dorsal portion;

the first dorsal portion traversing from the first roller to the second roller;

the second dorsal portion traversing from the first roller to the second roller;

the first roller being oriented at an obtuse angle with the first dorsal portion; and the first roller being oriented at an acute angle with the second dorsal portion.

6. The apparatus for carrying and transporting goods as claimed in claim 3 comprises:

the second roller being oriented normal to the first leg and the second leg.

7. The apparatus for carrying and transporting goods as claimed in claim 1 comprises:

the securing device further comprises a fastener;

the strap comprises a first face and a second face;

the fastener comprises a first interlocking portion and a second interlocking portion;

the first interlocking portion being connected onto the first face;

the second interlocking portion being connected onto the second face; and the first interlocking portion and the second interlocking portion being positioned opposite to each other along the strap.

8. The apparatus for carrying and transporting goods as claimed in claim 1 comprises:

the second brace end being centrally positioned along the strap.

9. The apparatus for carrying and transporting goods as claimed in claim 1 comprises:

wherein the securing device is arranged into an operative configuration; and the elongated brace traversing out of the structural channel.

10. The apparatus for carrying and transporting goods as claimed in claim 1 comprises:

wherein the securing device is arranged into a storage configuration; and the elongated brace traversing within the structural channel.

11. The apparatus for carrying and transporting goods as claimed in claim 1, wherein the fastening mechanism is a hook.

12. The apparatus for carrying and transporting goods as claimed in claim 1, wherein the fastening mechanism is a clamp device.

* * * * *